US007628213B2

(12) United States Patent
Telfer

(10) Patent No.: US 7,628,213 B2
(45) Date of Patent: Dec. 8, 2009

(54) MULTI-CYCLE DOWNHOLE TOOL WITH HYDRAULIC DAMPING

(75) Inventor: George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 464 days.

(21) Appl. No.: 10/543,697

(22) PCT Filed: Dec. 30, 2003

(86) PCT No.: PCT/GB03/05714

§ 371 (c)(1),
(2), (4) Date: Jan. 19, 2006

(87) PCT Pub. No.: WO2004/067908

PCT Pub. Date: Aug. 12, 2004

(65) Prior Publication Data

US 2006/0124317 A1 Jun. 15, 2006

(30) Foreign Application Priority Data

Jan. 30, 2003 (GB) ..... 0302121.9

(51) Int. Cl.
*E21B 37/00* (2006.01)
*E21B 34/06* (2006.01)

(52) U.S. Cl. ..... 166/381; 166/222; 166/312; 166/318; 166/332.4; 166/334.4

(58) Field of Classification Search ..... 166/312, 166/169, 222, 332.4, 332.1, 318, 320, 321, 166/334.4, 381
See application file for complete search history.

(56) References Cited

U.S. PATENT DOCUMENTS

| | | | | |
|---|---|---|---|---|
| 3,371,729 | A * | 3/1968 | Carr | 175/293 |
| 4,574,894 | A * | 3/1986 | Jadwin | 175/317 |
| 5,103,906 | A * | 4/1992 | Schultz et al. | 166/264 |
| 5,195,585 | A | 3/1993 | Clemens et al. | |
| 5,911,285 | A * | 6/1999 | Stewart et al. | 175/317 |
| 6,006,838 | A | 12/1999 | Whiteley et al. | |
| 6,065,541 | A | 5/2000 | Allen | |
| 6,173,795 | B1 * | 1/2001 | McGarian et al. | 175/231 |
| 6,227,291 | B1 | 5/2001 | Carmichael et al. | |
| 6,253,861 | B1 | 7/2001 | Carmichael et al. | |
| 6,263,969 | B1 * | 7/2001 | Stoesz et al. | 166/334.4 |
| 6,609,569 | B2 * | 8/2003 | Howlett et al. | 166/264 |
| 6,732,793 | B1 * | 5/2004 | Lee | 166/222 |
| 2004/0011566 | A1 * | 1/2004 | Lee | 175/317 |

FOREIGN PATENT DOCUMENTS

WO WO 97/47850 12/1997

(Continued)

*Primary Examiner*—Jennifer H Gay
*Assistant Examiner*—Robert E Fuller
(74) *Attorney, Agent, or Firm*—Osha Liang LLP

(57) ABSTRACT

A downhole tool which includes a locking bar to allow movement of a sleeve within the tool over a pre-defined range. The range is defined by a recess arranged axially or circumferentially in the tool, in which the bar locates. Fluid can be vented from the recess to provide a hydraulic brake, to prevent premature shearing of any shear pins in the tool. A stabiliser, jetting and circulating tool is described including the locking bar together with applications when incorporated in a bottom hole assembly. The tool allows multiple operations to be performed on a single trip.

21 Claims, 7 Drawing Sheets

FOREIGN PATENT DOCUMENTS

| | | | |
|---|---|---|---|
| WO | WO 01/61147 | A1 | 9/2001 |
| WO | WO 02/061236 | A1 | 8/2002 |
| WO | WO 02/068796 | A1 | 9/2002 |
| WO | WO 03/087526 | A1 | 10/2003 |

* cited by examiner

MULTI-CYCLE DOWNHOLE TOOL WITH HYDRAULIC DAMPING

CROSS-REFERENCE TO RELATED APPLICATIONS

This patent application claims priority from PCT/GB03/005714, having an international filing date of 30 Dec. 2003, and a priority date of 30 Jan. 2003.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The present invention relates to downhole tools as used in the oil and gas industry and in particular, though not exclusively, to a downhole tool which includes a lock bar to allow movement of a sleeve within the tool over a predefined range.

While many downhole tools operate continuously through a well bore e.g. scrapers and brushes as disclosed in U.S. Pat. No. 6,227,291, it is more desirable to provide a tool which performs a function only when it has reached a preferred location within a well bore. An example of such a tool would be a circulation tool as disclosed in WO 02/061236. The tool provides a cleaning action on the walls of the casing or lining of the well bore. The cleaning action is only required after the casing has been brushed or scraped and thus the tool is designed to be selectively actuated in the well bore. Such tools provide the advantage of allowing an operator to mount a number of tools on a single work string and operate them individually on a single trip in to the well bore. This saves significant time in making the well operational.

Tools which are selectively actuable in a well bore commonly operate by having an element which can be moved relative to the tool when in the well bore. In the circulation tool of WO 02/061236, the element is a sleeve located in the cylindrical body of the tool. When run in the well, the sleeve is held in a first position by one or more shear screws. To actuate the tool, a drop ball is released from the surface of the well through the work string. On reaching the sleeve, the ball blocks the flow of fluid through the tool and consequently pressure builds up until the shear screws shear and the sleeve is forced downwards. The movement of the sleeve is then stopped when a lower ledge of the sleeve contacts a shoulder on the internal surface of the tool body.

Such tools have a number of disadvantages. The tools are generally limited to one actuable movement. If two sleeves are incorporated to overcome this, the shear screws of the second sleeve can operate prematurely under the shock created to shear the shear screws of the first sleeve. Additionally, it is difficult to machine a circumferential shoulder into the central bore of a tool. To overcome this, the body is generally provided in two parts with different bore diameters, so that when they are screwed together a shoulder is created. This two part construction is expensive and is prone to weakness at the point where the parts meet. The reduced bore diameter of the lower part also effects the flow rate achievable through the tool.

It is an object of the present invention to provide a downhole tool which obviates or mitigates at least some of the disadvantages of the prior art.

It is a further object of at least one embodiment of the present invention to provide a downhole tool in which movement of a sleeve is controlled within a well bore.

It is yet further object of at least one embodiment of the present invention to provide a downhole tool in which hydraulic damping occurs to prevent premature shearing within the tool following a shock.

BRIEF SUMMARY OF THE INVENTION

According to a first aspect of the present invention there is provided a downhole tool, the tool comprising:

a substantially cylindrical body having a central bore running axially therethrough, a sleeve located within the bore, the sleeve including a recess on an outer surface, at least one locking bar, the locking bar being an elongate member having a first and a second end, the at least one locking bar being located through the body and substantially perpendicular to the central bore, the first end of the at least one locking bar being located in the recess, and wherein the body and the sleeve move relative to each other by virtue of the bar moving within the recess.

Thus the tool of the present invention allows a sleeve within the tool to move over a distance defined by the recess. As the bar moves within the recess there is no requirement for a shoulder in the central bore.

Preferably the cylindrical body includes a first and a second end for connection in a work string. More preferably the cylindrical body is of unitary construction.

Preferably the recess is dimensioned to allow movement of the sleeve axially relative to the body. Thus the recess may comprise an elongate channel having a width substantially similar to the width of the first end of the bar.

Alternatively the recess is dimensioned to allow movement of the sleeve circumferentially with respect to the body. Thus the recess may comprise a circumferential groove on the outer surface of the sleeve.

Preferably one or more shear screws are located between the sleeve and the body. Shearing of the shear screws free the sleeve to move relative to the bar.

Preferably the/each locking bar includes a port for venting fluid within the recess to an outer surface of the body. Fluid within the recess provides hydraulic damping when the sleeve moves. Thus a hydraulic break is provided when the shear screws shear and prevent premature shearing of any other shear screws provided in the tool.

Advantageously a magnet is located on the first end of the/each lock bar. The magnet ensures a sealing contact between the bar and the recess.

Preferably the sleeve includes one or more ports located between an inner surface of the sleeve and an outer surface of the sleeve. The ports may be transverse to the central bore or they may be at an angle relative to the central bore. Preferably also, the body includes one or more ports arranged between the central bore and the outer surface of the body. The ports may be transverse to the central bore or they may be at an angle relative to the central bore. When the tool is in an actuated position the ports of the sleeve may align with the ports of the body to provide for the passage of fluid from the central bore to a casing or liner of the well bore. Thus the tool could be a jetting tool.

The tool may further comprise an outer sleeve arranged circumferentially around the body. The outer sleeve may include raised portions which act to stabilise the tool when in a well bore. Thus the tool may act as a stabiliser and replace a conventional stabiliser in a BHA (Bottom Hole Assembly). The outer sleeve may include one or more radial ports through which fluid may pass. More preferably the one or more radial ports include one or more nozzles to provide a jetting action to the fluid. Advantageously channels may be provided on the outer surface of the body to connect the ports of the body with the radial ports of the outer sleeve and thus fluid is jetted from the central bore, through the sleeve, the body and the outer sleeve to the well bore casing or liner. Preferably the nozzles are located on the raised portions to improve the cleaning action of the tool.

Preferably the sleeve includes a first shoulder, the first shoulder being located circumferentially on the inner surface of the sleeve. The shoulder provides a contact point for a drop ball or the like to seal the central bore and provide sufficient pressure increase to shear the shear pins holding the sleeve in place.

Preferably also the sleeve includes a second shoulder, the second shoulder also being located circumferentially on the inner surface of the sleeve above the first shoulder. The second shoulder provides a contact point for a drop ball or the like to seal the central bore and provide sufficient pressure increase to shear a second shear pins holding the sleeve in place. Advantageously an inner diameter of the second shoulder is greater than an inner diameter of the first shoulder. In this way a first drop ball can fall through the second shoulder to contact the first shoulder.

In a preferred embodiment the sleeve comprises a first circumferential portion and a second circumferential portion, the second circumferential portion arranged inside the first circumferential portion. Each portion includes at least one recess for at least one locking bar. Preferably first locking bars are located between the body and the first circumferential portion and second locking bar(s) are located between the first and second circumferential portions. Shear pins preferably hold the portions together and to the tool body. The shoulders are preferably located on the second circumferential portion. Thus the portions can move together or independently on shearing of the pins, with their distance of movement controlled by the locking bars in the recesses.

Preferably the first circumferential portion includes at least bypass recess on an inner surface. The bypass recess, provides for the passage of fluid around the shoulder when a drop ball is in contact with the shoulder and the sleeve has moved as a result of the action of the drop ball.

Preferably the tool includes two sleeves and thus operates as a double jetting sub. In this embodiment four drop balls actuate the tool to provide two jetting actions. The diameter of each ball is progressively larger to contact the progressively larger shoulder diameters.

According to a second aspect of the present invention there is provided a method of moving a sleeve mounted in a cylindrical body of a downhole tool in a well bore, the method comprising the steps:

(a) locating a locking bar through the body and in to a recess on the outer surface of the sleeve;

(b) locating a shear screw through a portion of the body and the sleeve;

(c) releasing a drop ball to contact a shoulder of the sleeve and block fluid flow through the tool;

(d) shearing the shear pin as a result of the build up of pressure behind the drop ball;

(e) moving the locking bar relative to the sleeve by the distance of the recess; and (f) hydraulically braking the movement of the locking bar through the controlled release of fluid from the recess.

It will be appreciated that while a drop ball is described any other obturating projectile e.g. a dart could be used.

According to a third aspect of the present invention there is provided a method of performing multiple downhole operations on a single trip in a well bore, the method including the steps of:

(a) mounting a downhole tool on the work string, the tool comprising:

a tubular body having an axial throughbore and adapted for connection within a work string;

a sleeve mounted around the body, the sleeve including one or more stabiliser blades, said stabiliser blades including one more jetting ports to direct fluid from the axial throughbore onto a surface of the well bore; and one or more actuating means to selectively direct the fluid through the jetting ports and thereby circulate the fluid; and (b) selectively performing a plurality of operations from a group comprising:

(i) stabilising the work string in the well bore by keeping the distance between the stabiliser blades and the surface of the well bore as relatively small;

(ii) pumping loss circulation material by circulating fluid through the tool;

(iii) jet cleaning the well bore;

(iv) using the downhole tool in conjunction with a mud motor to shut down a bit at a shoe in the well bore to minimize wear of a casing in the wellbore while pumping fluid;

(v) running the downhole tool with a near bit reamer, de-activating blades of the reamer at a shoe in the wellbore and bypassing the bit with all mud pumped; and vi) retrieving a 'drill ahead' bore protector, wherein the sleeve of the downhole tool further includes a recess on an outer surface, and the tool further includes at least one locking bar, the locking bar being an elongate member having a first and a second end, the at least one locking bar being located through the body and substantially perpendicular to the central bore the first end of the at least one locking bar being located in the recess, and wherein the body and the sleeve move relative to each other within a range limited by virtue of the bar moving within the recess.

Preferably, the downhole tool is according to the first aspect.

Preferably, the step of jet cleaning includes one or more of the following steps:

(a) jet cleaning a low pressure housing;

(b) jet cleaning a high pressure wellhead; and (c) jet cleaning one or more downhole casing adapter profiles.

BRIEF DESCRIPTION OF THE DRAWINGS

An embodiment of the invention will now be described, by way of example only, with reference to the following drawings of which.

BRIEF DESCRIPTION OF THE DRAWINGS

Figures 1A, 1B, 1C:
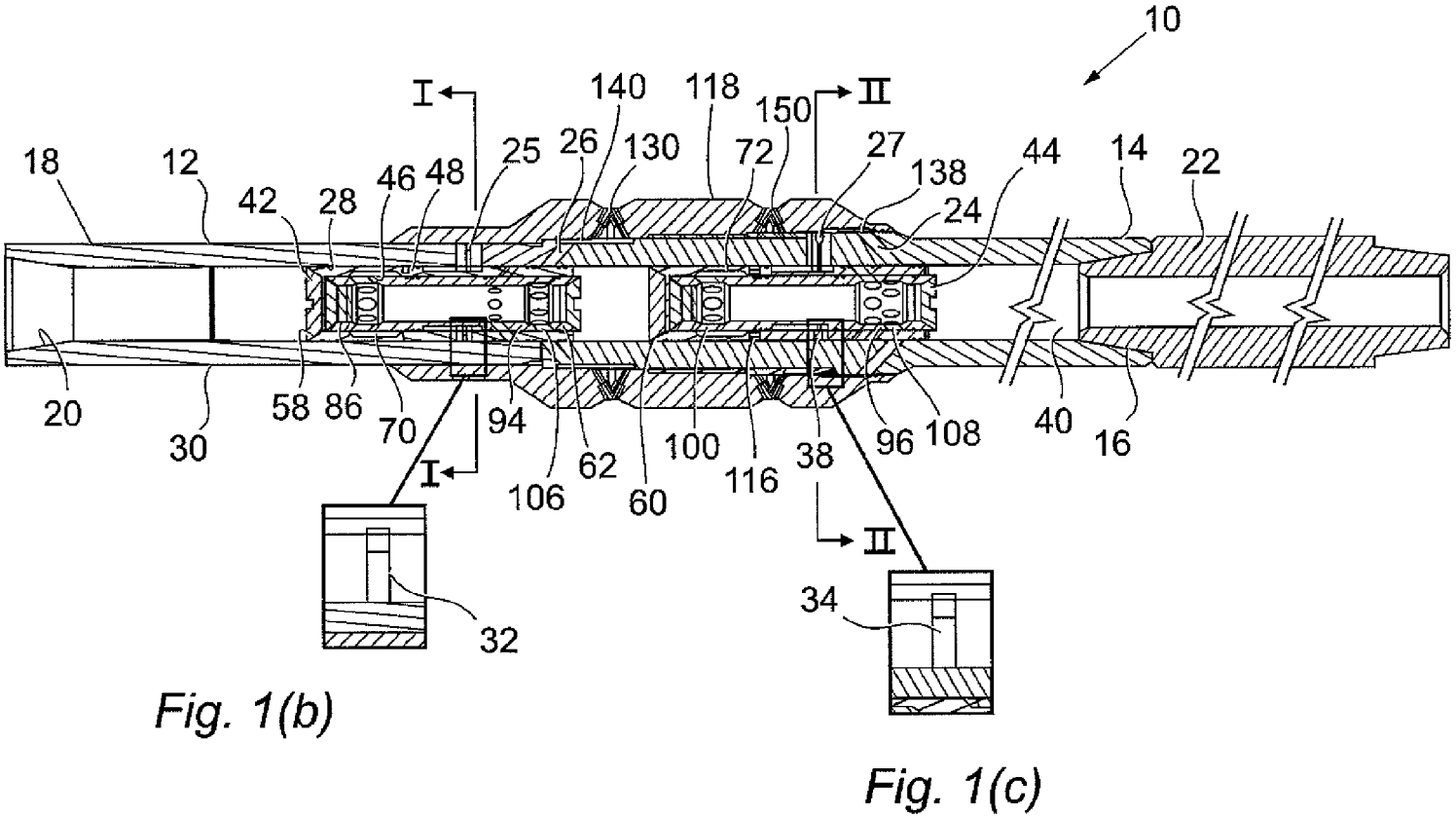
FIG. 1(*a*) is a cross-sectional view through a downhole tool according to an embodiment of the present invention with FIGS. 1(*b*), (*c*) and (*d*) being enlarged views of parts thereof.
Figure 1D:
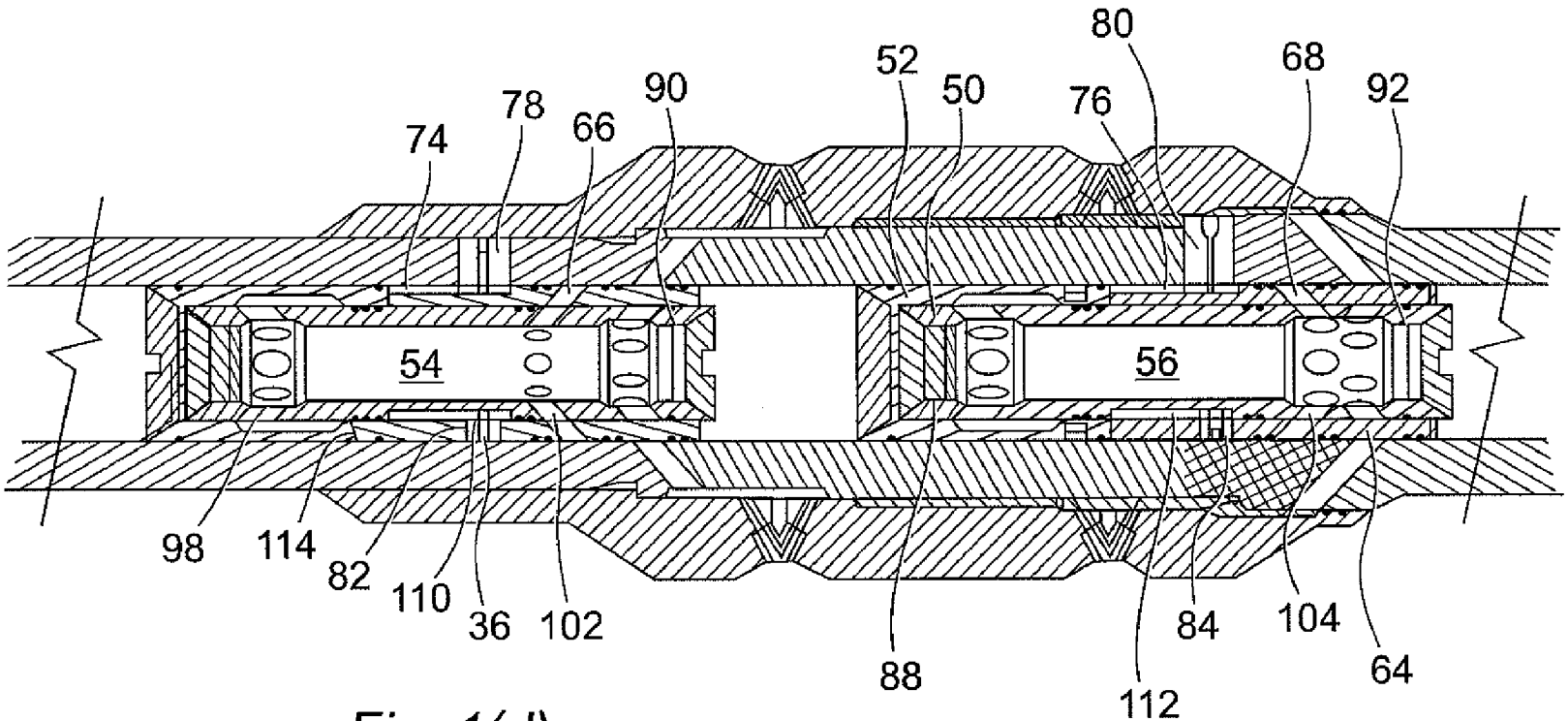

Reference is initially made to FIG. 1 of the drawings which illustrates a downhole tool, generally indicated by reference numeral 10, according to an embodiment of the present invention. The tool 10 is a double jetting tool, capable of producing selective jetting twice when in a well bore (not shown).

Tool 10 comprises a cylindrical body 12 of unitary construction having at an upper end 14, a conventional pin section 16 and at a lower end 18, a conventional box section 20 for connection of the tool in a work string (not shown). In the embodiment shown a saver sub 22 is attached to the pin section 16. This is optional and is generally used to protect the pin section 16 in mounting and demounting of the tool in the work string. Further the body 12 has a central bore 40 of uniform diameter, thus the body 12 can be easily manufactured from standard tubing with only machining required to be done on an outer surface 30 of the body 12. Body 12 includes twelve ports connecting an inner surface 28 of the body to the outer surface 30 of the body. The ports are arranged in two pairs 24, 26 of six ports. Each pair 24, 26 of ports is arranged equidistantly around the circumference of the body. A pair of opposed access ports, one of each pair being shown in FIG. 1(*a*), 25, 27 is located through the body 12 into which are positioned outer locking bars 78,80 (shown in FIG. 1(*d*)) which will be described hereinafter with reference to FIGS. 2 and 3. Further venting ports 32, 34 are arranged on the tool body 12 for venting fluid via inner locking bars 36, 33 as shown in FIGS. 1(*b*), (*c*), and (*d*) as will be described hereinafter.

Located within the body 12 against the inner surface 2B are two sleeves 42, 44. Each sleeve 42, 44 comprises two cylindrical portions 46, 48 and 50, 52 (shown in FIG. 1(*d*)) respectively. Inner cylindrical portions 46, 50 provide a sliding fit within central bores 54, 56 of outer cylindrical portions 48, 52 respectively. Each outer cylindrical portion 48, 52 has a conical entry port which funnels a drop ball towards the central bore 54,56 of the outer cylindrical portions 48, 52. Arranged in the wall 62, 64 of the outer portions are six equidistantly spaced ports 66, 68. The ports 66, 68 are arranged at approximately 45 degrees to the central bore 54, 56. A circumferential groove 70, 72 is located on the wall 62,64 facing the inner portion 46, 50. This groove 70, 72 acts as a bypass channel as described hereinafter with reference to the operation of the tool 10. On the wall 62, 64 facing the body are respective opposed slots 74, 76 (see FIGS. 2, 3). The slots 74, 76 are arranged longitudinally and parallel with the central bore 54, 56. The slots 74, 76 provide a recess into which outer locking bars 78, 80 locate and define the movement of the bars 78, 80 with respect to the sleeve 42, 44. The outer locking bars 78, 80 will be described hereinafter. Further two opposed access ports 82, 84 are provided through the wall 62, 64 into which are mounted the inner locking bars 36, 38.

The inner cylindrical portions 46, 50 each have a conical entry port 86, 88 which funnels a drop ball towards the central bore 54,56 of the cylindrical portions 46,50. Conical exit ports 90, 92 are arranged are on the opposite end of the bores 54, 56 also. The diameter of the ports 86, 88, 90, 92 determines the size of drop ball which will seal the central bore 40 of the tool 10. Arranged in the wall 94, 96 of each of the inner cylindrical portions are three sets of six equidistantly spaced ports 98, 100, 102, 104, 106, 108. The ports are arranged at approximately 45 degrees to the central bore 54, 56. On the wall 94, 96 facing the body are two opposed slots 110, 112. The slots 110, 112 are arranged longitudinally and parallel with the central bore 54, 56. The slots 110, 112 provide a recess into which inner locking bars 36, 38 locate and define the movement of the bars 36, 38 with respect to the inner cylindrical portions 46, 50.

The inner cylindrical portions 46, 50 are held to the outer cylindrical portions 48, 52 by shear screws 114, 116. These same shear screws 114, 116 have a second shear face so that they additionally hold the outer cylindrical portions 48,52 to the body 12. Typically twelve shear screws are arranged circumferentially around the sleeves 42, 44. In this way the portions can be separated from each other at a lower force than that required to separate the sleeves from the body.

Figure 2:
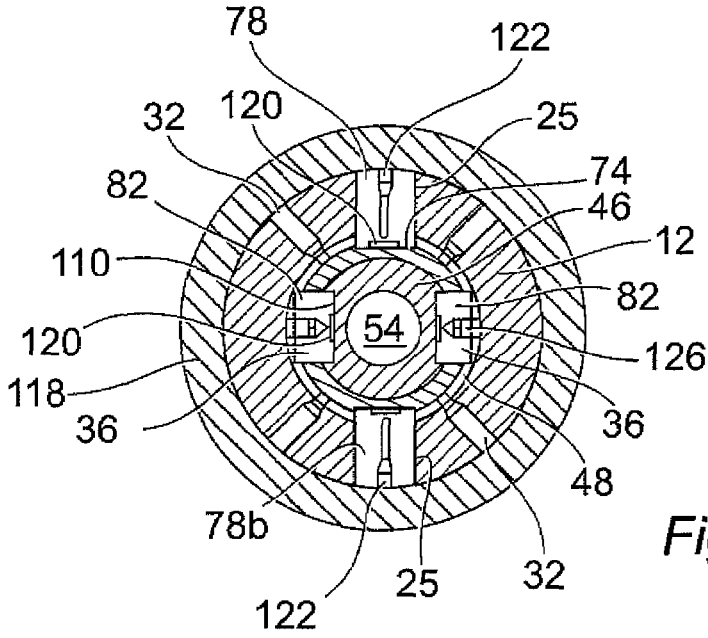
FIG. 2 is a sectional view taken through the line I-I of FIG. 1.
Figure 3:
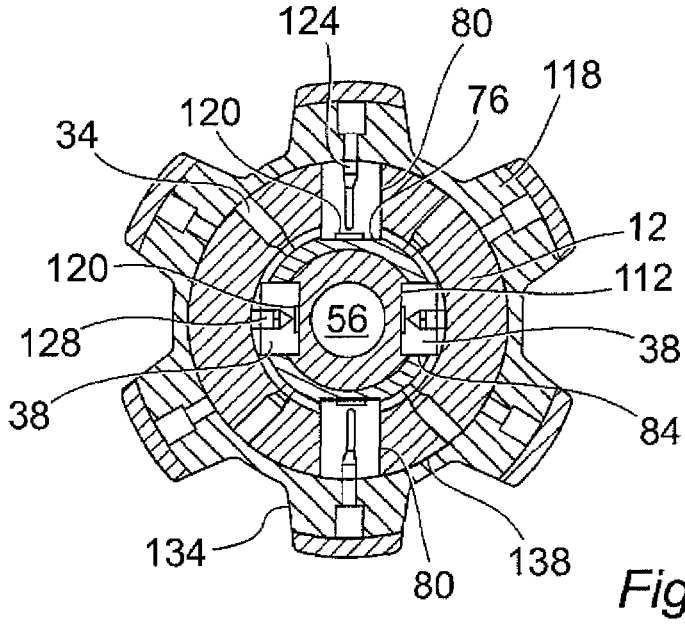
FIG. 3 is a sectional view taken through the line II-II of FIG. 1.

The arrangement of the locking bars 36, 38, 78, 80 is best seen with the aid of FIGS. 2 and 3. Each bar 36, 38, 78, 80 is a bar that extends substantially across the full cross section of the access ports and has one edge that has been rounded to fit with the inner circumference of the body 12 and a sleeve 118 located over the body 12 respectively. The outer locking bars 78, 80 fill the access ports 25, 27 in the body 12 and locate in the slots 74, 76 in the outer cylindrical portions 48, 52. The inner locking bars 36, 38 fill the access ports 82, 84 in the outer portions 48, 52 and locate in the slots 110, 112 in the inner cylindrical portions 46, 50. Within each bar 36, 38, 78, 80 are located fluid release ports 122, 126, 124, 128. These ports with the venting ports 32, 34 provide for the passage of fluid from the slots 74, 76, 110, 112 to the outside of the tool 10 via paths between the cylindrical components. Magnets 120 are affixed to the surfaces of the bars 36, 38, 78, 80 to ensure a seal with the slots 74, 76, 110, 112.

Figure 4:
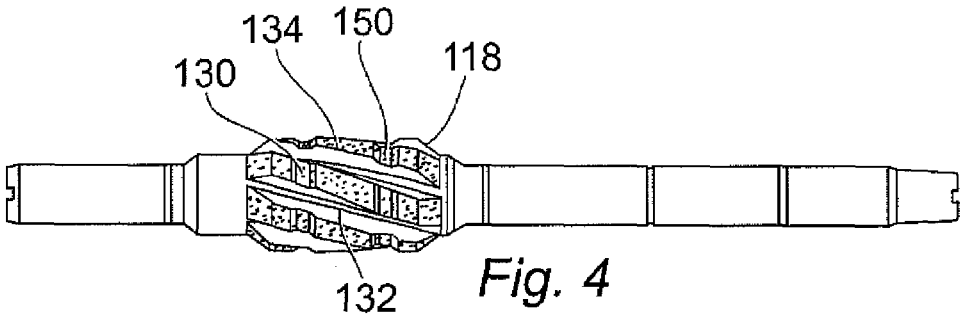
FIG. 4 is a schematic view of the tool of FIG. 1.
Figure 5A:
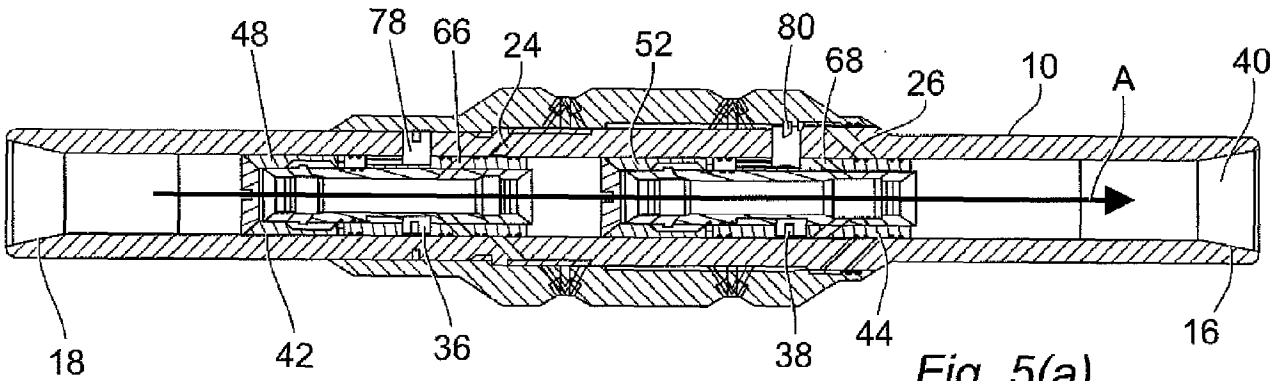
FIGS. 5(*a*) to (*e*) show schematic illustrative diagrams of the operating positions of the tool of FIG. 1.
Figure 5B:
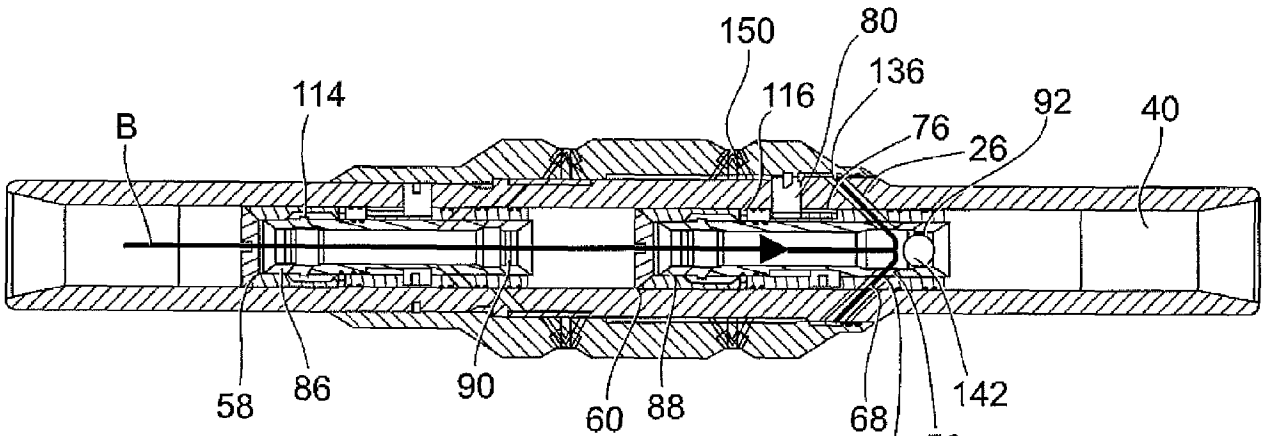
Figure 5C:
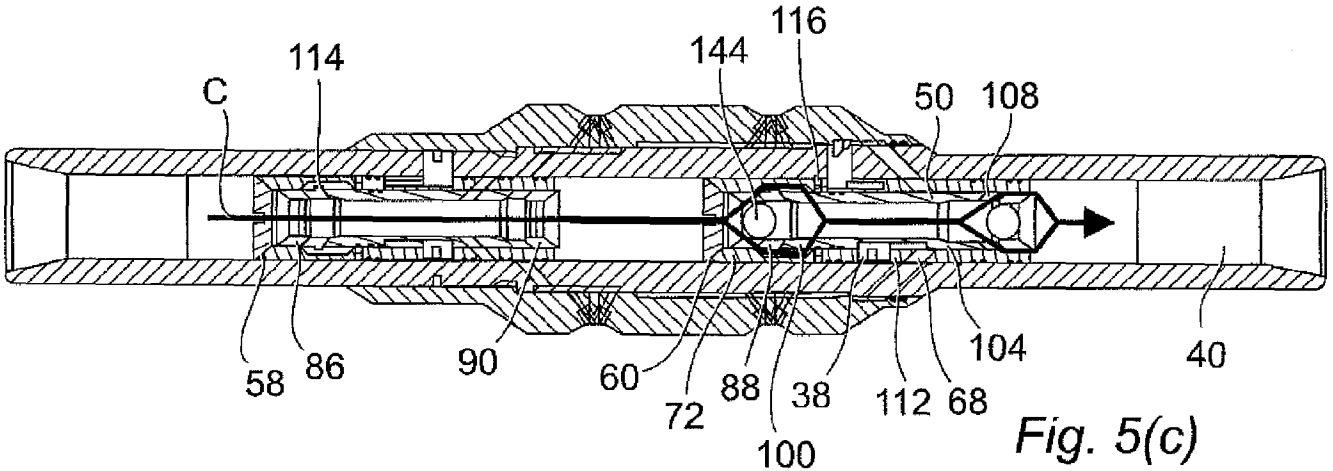
Figure 5D:
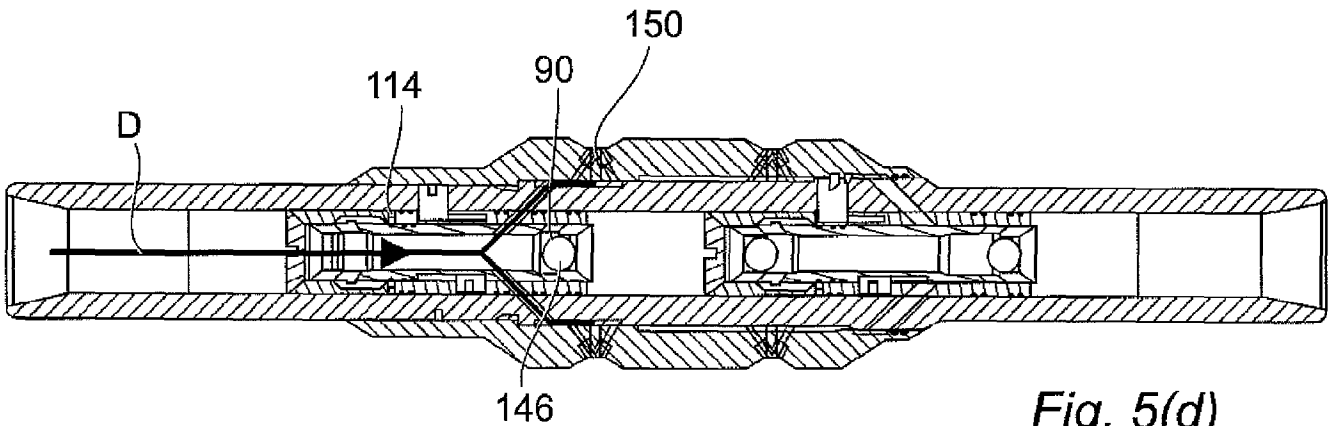
Figure 5E:
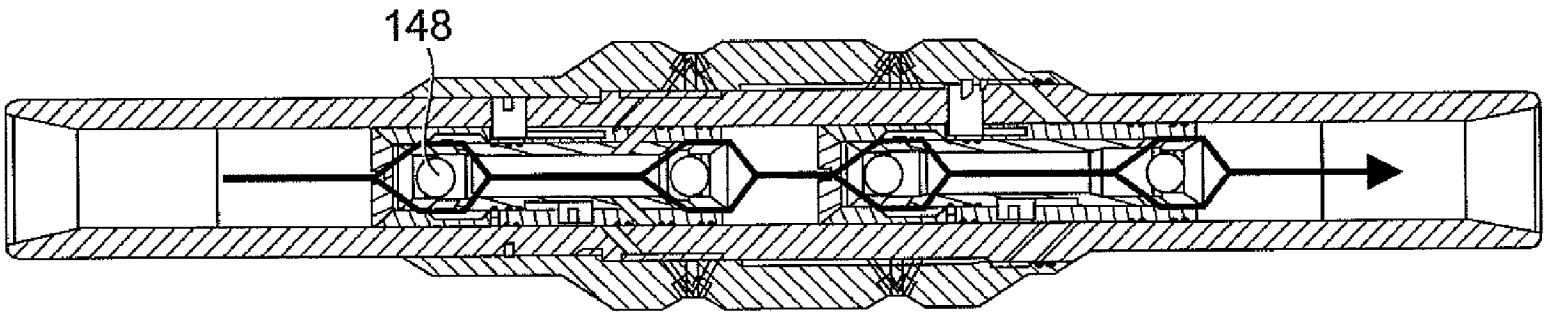

Reference is now made to FIG. 4 of the drawings which shows the sleeve 118 located over the body 12. A cross-section of the sleeve 118 is also shown in FIG. 1. Sleeve 118 converts the tool 10 to a jetting and stabiliser tool. The jetting function is provided by ports 130,150 located through the sleeve 118. Each port 130, 150 is made of plurality of smaller ports, in this case three. Within the smaller ports are located nozzles to increase the speed of fluid jetting from the tool 10. On the outer surface 132 of the sleeve 118 are arranged 6 raised portions 134. The raised portions 134 spiral around the sleeve 118 to provide a uniform contact with casing or liner within a well bore. Thus the portions 134 act as stabilisers to the tool 10. On the inner surface 136 of the sleeve 118 and the outer surface 30 of the body 12 are located recesses 138,140 respectively to provide for the passage of fluid radially from the tool 10.

In use, sleeves 42, 44 are located in the bore 40 and held in place by the locking bars 36, 38, 78, 80 and the shear screws 114, 116. The tool 10 is mounted on a work string using the pin section 16 and the box section 20. An optional saver sub 22 may be used with the tool 10. The tool can then be run in a casing or liner of a well bore. The raised portions 134 on the sleeve 118 will contact the casing or liner and stabilise the tool 10 in the well bore.

In this first position, illustrated in FIG. 5(*a*), the ports 24, 26, of the body are misaligned with the ports 66, 68 of the outer portion 48, 52 and thus fluid is prevented from jetting radially from the tool 10. All fluid flow is therefore through the central bore 40 as shown by arrow A. In the preferred embodiment the tool provides a flow through area of 4.2 square inches.

Referring to FIG. 5(*b*), when the tool 10 is located in the well bore at a position where jetting is required, the tool 10 is actuated by dropping a drop ball 142, through the work string from the surface of the well. Drop ball 142 has a preferred diameter of 2⅜ inch. The ball 142 is carried in the fluid and passes through the conical ports 58, 86, 90, 60, 88 and sticks in the lower exit port 92. As the ball 142 blocks the passage of fluid through the bore 40, fluid pressure builds up behind the ball 142 until the pressure is sufficient to shear the weaker plane of the shear screws 116 between the sleeve 44 and the body 12. The sleeve 44 is free to move away from the body 12 along the bore 40. As the sleeve 44 moves, the outer locking bar 80 will slide within the slot 76 until it abuts the end of the slot 76. At this point the sleeve 44 is halted.

As the bar 80 moves in the slot 76, fluid is forced from the slot 76 through the escape port 124. The escaping fluid provides a hydraulic braking effect to the movement of the sleeve 44. By braking this movement, any shock created within the tool 10 is reduced and thus the remaining planes of the shear pins 114,116 are prevented from shearing prematurely.

On movement of the sleeve 44, as shown in FIG. 5(*b*), ports 26, 68 and 104 align. This alignment provides a passage for fluid radially from the tool 30, by passing from the central bore 40, through the ports 26, 68, 104 along the recess 138 and from the port 150. Thus, as shown by arrow B, fluid is jetted from the tool 10. In the preferred embodiment 18 jets are active providing a flow area of 2.7 square inches.

Referring to FIG. 5(*c*), when jetting is no longer required, a second drop ball 144 is released into the work string. The ball 144 has a preferred diameter of 2½ inch. The ball 144 is carried in the fluid and passes through the conical ports 58, 86, 90, 60 and sticks in the entry port 88. As the ball 144 blocks the passage of fluid through the bore 40 to the ports 26, 68, 104, fluid pressure builds up behind the ball 144 until the pressure is sufficient to shear the second plane of the shear screws 116 between the outer portion 52 and the inner portion 50 of the sleeve 44. The inner portion 50 is free to move away from the outer portion 52 along the bore 40. As the inner portion 50 moves, the inner locking bar 38 will slide within the slot 112 until it abuts the end of the slot 112. At this point the inner portion 50 is halted.

As the bar 38 moves in the slot 112, fluid is forced from the slot 112 through the escape port 128 and the vent port 34. The escaping fluid provides a hydraulic braking effect to the movement of the inner portion 50. By braking this movement, any shock created within the tool 10 is reduced and thus the remaining planes of the shear pins 114 are prevented from shearing prematurely.

In this position, illustrated in FIG. 5(*c*), fluid, as shown by arrow C, returns through the tool, This is achieved by fluid accessing the groove 72, open by virtue of the inner portion 50 moving; bypassing the ball 144; returning to the bore 56 through port 100; travelling out port 108 to bypass the first ball 142 and travel down the bore 40. In the preferred embodiment the fluid flow through in this position is 5.16 square inches.

Movement of the inner portion 50 also causes misalignment of ports 68,104 to prevent any radial passage of fluid to the jets 150.

If a further jetting action is required a third drop ball 146 is released into the work string. This actuates sleeve 42 in an identical manner to sleeve 44 by virtue of the ball sticking in port 90. Ball 146 preferably has a diameter of 2½ inch. Jetting now occurs through ports 130 as shown by arrow D in FIG. 5(*d*).

Similarly, when jetting is no longer required a fourth drop ball 148 is released into the work string to provide longitudinal passage of fluid through the work string again in an identical manner to the dropping of ball 144. Ball 148 preferably has a diameter of 2¾ inch and when actuated provides a tool 10 with a fluid flow through area of 6.28 square inches. This is illustrated in FIG. 5(*e*).

Figure 6:
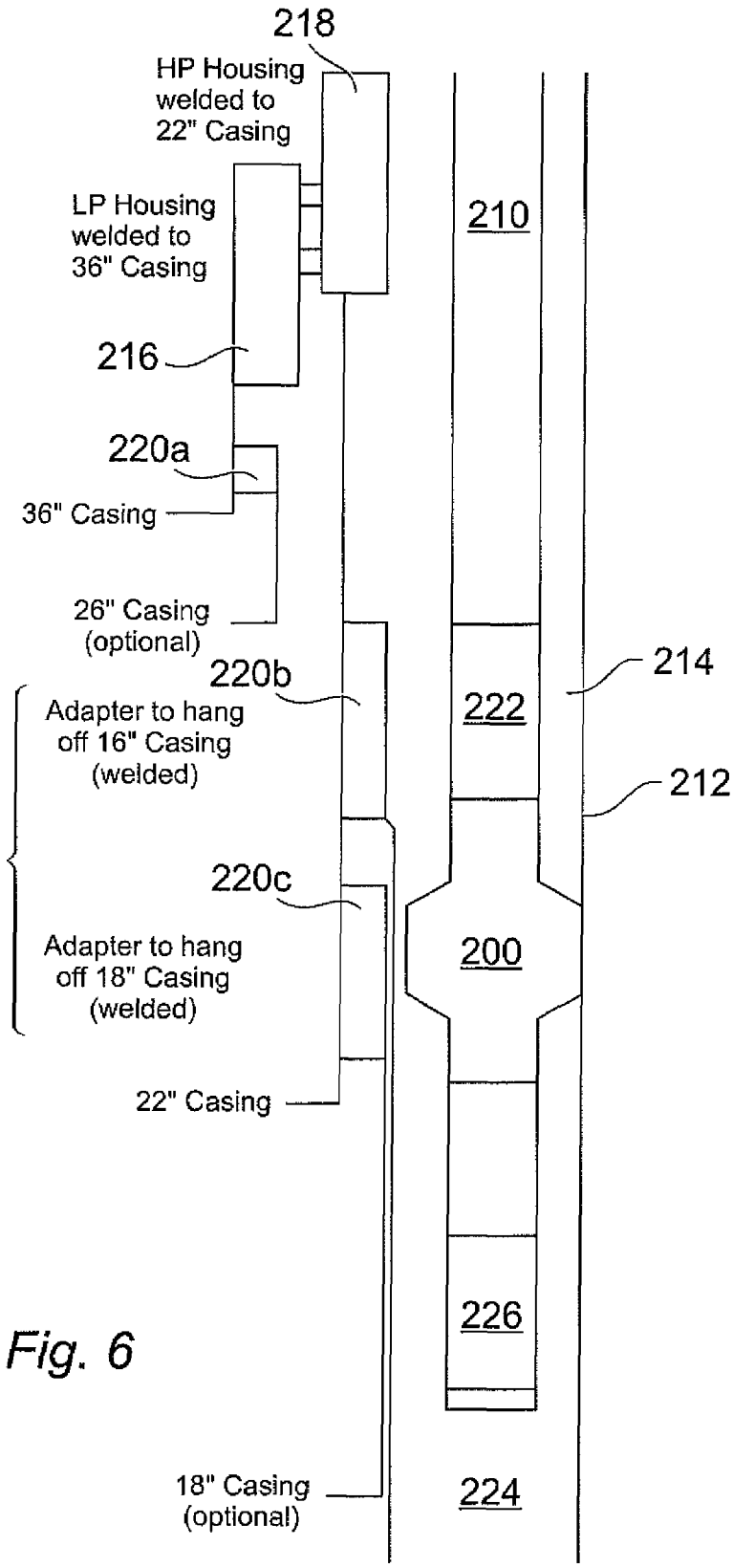
FIG. 6 is an illustrative view of a jetting tool in use in a well bore.

A jetting and circulating tool as described hereinbefore, has a number of application areas as illustrated with the aid of FIG. 6. FIG. 6 illustrates a jetting tool 200, mounted on a work string 210. The work string 210 is located in a well bore 212. The work string allows a combination of actions to be carried out on a single trip. Those skilled in the art will recognise that the tool 200 provides increased annular velocities for hole cleaning. When located in a bottom hole assembly (BHA) 214, the tool 200 can replace a conventional stabiliser as the stabiliser blades and the surface of the well bore are maintained at a relatively small separation. The tool 200 can be used to pump lost circulation material by circulating fluid through the tool.

By circulating fluid through the ports, jet cleaning can be performed on the LP (low pressure housing) 216, the HP wellhead 218 and the downhole casing adapter profiles 220*a, b,c*. When the tool 200 is run in conjunction with a mud motor, used to shut down the bit at the shoe to minimise casing wear while pumping (to condition the mud and remove cuttings from the well bore 224. Additionally when the tool 200, is run in conjunction with a near bit reamer 222, it can be used to de-activate the reamer blades at the shoe and bypass the bit 226 with all mud pumped. Further it will be recognised that secondary recovery of the 'drill ahead' bore protector is achievable. Each of these operations can be selectively achieved on a single trip into the well bore.

Thus when the tool 200 is used in a drilling assembly, the tool is not actuated during the drilling operation, but acts as a stabiliser. On completion of drilling, the tool can be used to boost drill cuttings. Further as the tool is pulled out of the hole, cleaning can be performed without requiring a second trip into the well bore. By the angling of the jets, effective cleaning can be performed on the casing hangar areas on a high pressure tree system.

It will be appreciated that although the embodiment has been described as a jetting tool, the tool is more fully described as a stabiliser, jetting and circulating tool.

The principal advantage of the present invention is that it provides a tool in which movement of a sleeve is controlled within a well bore. A further advantage of an embodiment of the present invention is that it provides a tool in which hydraulic damping occurs to prevent premature shearing within the tool following a shock.

A yet further advantage to an embodiment of the present invention is that it provides a jetting tool having a dual or double action. Further this action does not limit the fluid flow through the tool after each jetting function occurs. Thus any number of actuable movements could be achieved within a tool, the limit being only on the minimum diameter of drop ball available.

A yet further advantage of the present invention is that it combines a number of functions on a single tool within a well bore. For example, it provides a large outer diameter jetting and circulating device that acts as a drilling stabiliser as well and can be activated by different means one or more times. Thus, specific areas within the well can be jetted at various times without retrieval of the string from the well. It can replace a conventional stabiliser used in a bottom hole assembly. Further, drilling can be performed with this tool mounted in the bottom hole assembly and the tool can be also used to pump mud while drilling. Alternatively, the tool can be used to jet clean the low pressure housing, the high pressure well head and downhole casing adapter profile, as it is more effective than using the bit and does not require an extra trip into the well. The tool can further be run in conjunction with a mud motor and can be used to shut down the bit at the shoe to minimise casing wear while pumping. It will also be appreciated that the tool may be run in conjunction with an under reamer and can be used to deactivate blades at a shoe. Thus it can be used in preference to dropping a dart.

It will be appreciated by those skilled in the art that various modifications may be made to the invention herein described without departing from the scope thereof. For example, while an embodiment of a jetting sub is illustrated the present invention could be applied to other circulation tools where selective access through a radial port is required within the well bore e.g. a cementing tool.

The invention claimed is:

1. A fluid-actuated downhole tool, the tool comprising:

a substantially cylindrical body having a central bore of uniform diameter running axially therethrough;

a sleeve located within the bore, the sleeve including a recess on an outer surface;

at least one locking bar, the at least one locking bar being an elongate member having a first and a second end;

wherein the at least one locking bar is located through the body and substantially perpendicular to the central bore, the first end of the at least one locking bar being located in the recess; and wherein the body and sleeve move relative to each other within a range limited by virtue of the bar moving within the recess, and wherein the at least one locking bar includes a port for venting fluid within the recess to an outer surface of the body.

2. The downhole tool claimed in claim 1 wherein the recess is dimensioned to allow movement of the sleeve axially relative to the body.

3. The downhole tool claimed in claim 1 wherein one or more shear screws are located between the sleeve and the body.

4. The downhole tool claimed in claim 1 wherein a magnet is located on the first end of the at least one locking bar.

5. The downhole tool claimed in claim 1 wherein the sleeve includes one or more ports located between an inner surface of the sleeve and an outer surface of the sleeve.

6. The downhole tool claimed in claim 1 wherein the body includes one or more ports arranged between the central bore and the outer surface of the body.

7. The downhole tool claimed in claim 6 wherein when the tool is in an actuated position the ports of the sleeve align with the ports of the body to provide a passage for fluid from the central bore to a casing or liner of the well bore.

8. The downhole tool claimed in claim 1 wherein the tool further comprises an outer sleeve arranged circumferentially around the body.

9. The downhole tool claimed in claim 8 wherein the outer sleeve includes raised portions which act to stabilize the tool when in a well bore.

10. The downhole tool claimed in claim 8 wherein the outer sleeve includes one or more radial ports through which fluid may pass.

11. The downhole tool claimed in claim 10 wherein channels are provided on the outer surface of the body to connect the ports of the body with the radial ports of the outer sleeve and thus fluid is jetted from the central bore, through the sleeve, the body and the outer sleeve to the well bore casing or liner.

12. The downhole tool claimed in claim 1 wherein the sleeve includes a first shoulder, the first shoulder being located circumferentially on the inner surface of the sleeve, to provide a ball seat.

13. The downhole tool claimed in claim 12 wherein the sleeve includes a second shoulder, the second shoulder being located circumferentially on the inner surface of the sleeve above the first shoulder, to provide a ball seat.

14. The downhole tool claimed in claim 13 wherein the inner diameter of the second shoulder is greater than an inner diameter of the first shoulder.

15. The downhole tool claimed in claim 1 wherein the sleeve comprises a first circumferential portion and a second circumferential portion, the second circumferential portion arranged inside the first circumferential portion; each portion includes at least one recess for at least one locking bar; first locking bars are located between the body and the first circumferential portion and second locking bar(s) are located between the first and second circumferential portions; shear pins hold the portions together and to the tool body; and the shoulders are located on the second circumferential portion.

16. The downhole tool claimed in claim 15 wherein the first circumferential portion includes at least one bypass recess on an inner surface.

17. A method of moving a sleeve mounted in a uniform diameter bore of a cylindrical body of a downhole tool in a well bore, the method comprising the steps:

(a) locating a locking bar through the body and into a recess on the outer surface of the sleeve;

(b) locating a shear screw through a portion of the body and the sleeve;

(c) releasing a drop ball to contact a shoulder of the sleeve and block fluid flow through the tool;

(d) shearing the shear pin as a result of the build up of pressure behind the drop ball;

(e) moving the locking bar relative to the sleeve by the distance of the recess; and (f) hydraulically braking the movement of the locking bar through the controlled release of fluid from the recess.

18. A downhole tool, the tool comprising:

a substantially cylindrical body having a central bore running axially therethrough; a sleeve located within the bore, the sleeve including a recess on an outer surface; at least one locking bar, the locking bar being an elongate member having a first and a second end and including a port for venting fluid within the recess to an outer surface of the body;

wherein the at least one locking bar is located through the body and substantially perpendicular to the central bore, the first end of the at least one locking bar being located in the recess, and wherein the body and sleeve move relative to each other within a range limited by virtue of the bar moving within the recess.

19. A downhole tool, the tool comprising:

a substantially cylindrical body having a central bore running axially therethrough;

a sleeve located within the bore, the sleeve including a recess on an outer surface, a first shoulder located circumferentially on an inner surface of the sleeve, to provide a ball seat, a second shoulder located circumferentially on the inner surface of the sleeve above the first shoulder, to provide a further ball seat, and at least one locking bar, the locking bar being an elongate member having a first and a second end, wherein the at least one locking bar is located through the body and substantially perpendicular to the central bore, the first end of the at least one locking bar being located in the recess, and wherein the body and sleeve move relative to each other within a range limited by virtue of the bar moving within the recess; and wherein the at least one locking bar includes a port for venting fluid within the recess to an outer surface of the body.

20. A method of performing multiple downhole operations on a single trip in a well bore, the method including the steps of:

(a) mounting a downhole tool on a work string, the tool comprising:

a tubular body having an axial throughbore and adapted for connection within a workstring; a sleeve mounted around the body, the sleeve including one or more stabilizer blades, said stabilizer blades including one more jetting ports to direct fluid from the axial throughbore onto a surface of the well bore; and one or more actuating means to selectively direct the fluid through the jetting ports and thereby circulate the fluid; and (b) selectively performing a plurality of operations from a group consisting of:

(i) stabilizing the work string in the well bore by keeping the distance between the stabilizer blades and the surface of the well bore relatively small;

(ii) pumping lost circulation material (LCM) by circulating fluid through the tool;

(iii) jet cleaning the well bore;

(iv) using the downhole tool in conjunction with a mud motor to shut down a bit at a shoe in the well bore to minimize wear of a casing in the wellbore while pumping fluid;

(v) running the downhole tool with a near bit reamer, de-activating blades of the reamer at a shoe in the wellbore and bypassing the bit with all mud pumped; and (vi) retrieving a drill ahead bore protector, wherein the sleeve of the downhole tool further includes a recess on an outer surface, and the tool further includes at least one locking bar, the at least one locking bar being an elongate member having a first and a second end, the at least one locking bar being located through the body and substantially perpendicular to the central bore the first end of the at least one locking bar being located in the recess and including a port for venting fluid within the recess to an outer surface of the body, and wherein the body and the sleeve move relative to each other within a range limited by virtue of the bar moving within the recess.

21. The method claimed in claim 20 wherein the step of jet cleaning includes one or more of the following steps:

(a) jet cleaning a low pressure housing;

(b) jet cleaning a high pressure wellhead; and (c) jet cleaning one or more downhole casing adapter profiles.

* * * * *